US007055305B2

(12) United States Patent
Baxter et al.

(10) Patent No.: US 7,055,305 B2
(45) Date of Patent: Jun. 6, 2006

(54) EXHAUST GAS HOUSING OF A THERMAL ENGINE

(75) Inventors: Andrew Baxter, Rekingen (CH); Vladimir Navrotsky, Finspong (SE); Mirjana Mihelic, Karlovac (HR); Matthias Rothbrust, Dietikon (CH)

(73) Assignee: Alstom Technology LTD, Baden (CH)

( * ) Notice: Subject to any disclaimer, the term of this patent is extended or adjusted under 35 U.S.C. 154(b) by 122 days.

(21) Appl. No.: 10/357,378

(22) Filed: Feb. 4, 2003

(65) Prior Publication Data

US 2003/0150205 A1 Aug. 14, 2003

(30) Foreign Application Priority Data

Feb. 9, 2002 (DE) ..... 102 05 429

(51) Int. Cl.
*F02C 7/12* (2006.01)

(52) U.S. Cl. ..... 60/39.5; 60/806; 415/115

(58) Field of Classification Search ..... 60/39.5, 60/266, 782, 806; 415/115, 116, 117
See application file for complete search history.

(56) References Cited

U.S. PATENT DOCUMENTS

| | | | | |
|---|---|---|---|---|
| 3,631,672 A | * | 1/1972 | Gentile et al. | 415/116 |
| 3,751,909 A | * | 8/1973 | Kohler | 415/115 |
| 4,120,150 A | | 10/1978 | Wakeman | |
| 4,271,666 A | * | 6/1981 | Hurley et al. | 415/116 |
| 4,920,742 A | | 5/1990 | Nash et al. | |
| 4,958,489 A | | 9/1990 | Simmons | |
| 5,144,793 A | | 9/1992 | Able et al. | |
| 5,255,849 A | | 10/1993 | Mayer et al. | |
| 5,483,794 A | | 1/1996 | Nicoll et al. | |
| 5,564,896 A | | 10/1996 | Beeck et al. | |

FOREIGN PATENT DOCUMENTS

| | | |
|---|---|---|
| DE | 4304989 A1 | 8/1994 |
| DE | 4435322 A1 | 4/1996 |
| EP | 0287499 A2 | 10/1988 |
| EP | 0344877 A1 | 12/1989 |
| EP | 1108858 A2 | 6/2001 |

OTHER PUBLICATIONS

Great Britain Search Report dated Jul. 30, 2003.

* cited by examiner

*Primary Examiner*—Louis J. Casaregola
(74) *Attorney, Agent, or Firm*—Buchanan Ingersoll PC

(57) ABSTRACT

In an exhaust gas housing (1) of a thermal engine, a radially outer housing casing (9) and a radially inner housing casing (10) arranged on the hub side are connected to one another via at least one thermally insulated carrying rib (3) acted upon by a cooling medium. A carrying rib (3) has at least two passage ducts (7) and (8) for the cooling medium, at least one passage duct (7) possessing a cooling medium supply (6) and at least one passage duct (8) possessing a cooling medium outlet (12), and these passage ducts (7) and (8) being in communicating connection in the radially inner hub-side end region via a deflection duct (11). The cooling medium is led from an external pressure source (5) through the carrying rib (3) to the region of the deflecting duct (11) arranged on the hub-side casing (10) and from there through the carrying rib (3) back again into a collecting duct (15) which issues preferably into an annular duct (26) for cooling the exhaust gas housing flange (24).

14 Claims, 4 Drawing Sheets

EXHAUST GAS HOUSING OF A THERMAL ENGINE

This application claims priority under 35 U.S.C. §§119 and/or 365 to Appln. No. 102 05 429.0 filed in Germany on Feb. 9, 2002; the entire content of which is hereby incorporated by reference.

FIELD OF THE INVENTION

The invention relates to an exhaust gas housing of a thermal engine, consisting of a radially outer housing casing and, at a distance from the latter, a radially inner housing casing, said casings delimiting an annular exhaust gas duct, and of a plurality of carrying ribs which are cooled by means of a fluid cooling medium and which bridge the exhaust gas duct.

DISCUSSION OF BACKGROUND

It is known from DE 44 35 322 A1 subsequently to flange an exhaust gas housing onto the housing of a gas turbine. The exhaust gas housing consists essentially of a hub-side annular inner part and of an annular outer part which are connected to one another via a plurality of radial carrying ribs arranged uniformly over the circumference. The outlet-side mounting of the turbine shaft is arranged in the cavity within the annular inner part. For sealing off the mounting against hot exhaust gases, normally shaft seals are used and barrier air is injected. In addition, ambient air can be introduced into the bearing space via a fan and is transported outward via the shaft seal and through passages in the exhaust gas diffuser. This cooling air may also be used for cooling the annular inner part of the exhaust gas housing. For this purpose, cooling ducts are arranged in the inner part, which are located at the foot of the carrying ribs and are fed with cooling air via bores.

EP 1 108 858 A2 discloses an exhaust gas housing which, for the protection of the bearing of a gas turbine, has a special double-walled bearing housing, in order to protect the bearing of the turbine reliably from the exhaust gases. This special bearing housing is acted upon, in a way not explained in any more detail, by cooling air which is already used for the exhaust gas housing and which is likewise introduced via an external fan.

In the event of insufficient protection for the exhaust gas housing and of the associated carrying structure, in particular the carrying ribs, from the high thermal stresses caused by the hot exhaust gases, problems may arise with material creeping actions, thus leading to material defects. In the case of uneven exhaust gas temperature profiles, there may be a deformation of the carrying structure and consequently a deflection of the rotor out of center, which may lead to a failure of the thermal engine.

SUMMARY OF THE INVENTION

Accordingly, one object of the invention, in an exhaust gas housing of a thermal engine of the type initially mentioned, is to improve the cooling of the carrying structure of the exhaust gas housing, in order to avoid said disadvantages of the prior art.

According to the invention, in an exhaust gas housing of the type initially mentioned, this object is achieved in that the carrying ribs have at least two separate passage ducts for the cooling medium, at least one passage duct possessing a cooling medium supply and at least one passage duct possessing a cooling medium outlet, and these passage ducts being in communicating connection in one end region via a deflecting duct.

A method for achieving this object is distinguished, according to the invention, in that, for cooling the carrying ribs of an exhaust gas housing of a thermal engine, said exhaust gas housing consisting of an outer casing and of an inner casing, the fluid cooling medium enters at least one passage duct of the carrying rib in the region of the outer housing casing, flows through this passage duct as far as the region of the inner housing casing, is deflected there and flows in countercurrent, in at least one passage duct, through the carrying ribs as far as the region of the outer housing casing.

According to a favorable embodiment of the invention, the cooling medium flows into a collecting duct which issues into an annular duct shielding the thermally stressed surface of the exhaust gas housing flange.

The advantages of the invention are to be seen, inter alia, in that the temperature of the carrying structure in the exhaust gas housing is adjustable. A uniform temperature profile over the entire carrying structure can be generated via the cooling of the structure; this can be achieved even in regions which are exposed to very high exhaust gas temperatures. By means of comparatively low temperatures within the carrying ribs, material creeping actions and consequently material defects are prevented.

Further advantageous embodiments of the invention may be gathered from the dependent claims.

It is particularly expedient to use an external fan for introducing the cooling medium into the carrying ribs, since the temperature of the carrying structure in the exhaust gas housing can thereby be adjusted independently of other gas turbine parameters.

Furthermore, it is beneficial to equip the carrying ribs and the carrying structure with a thermally insulating casing, so that, in the event of a failure of the cooling medium, there is no impairment of the operating concept of the thermal engine; this is because the thermally insulating casing attenuates pronounced temperature fluctuations and consequently at least temporarily ensures fault-free further operation of the plant.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein In the drawings.

DETAILED DESCRIPTION OF THE INVENTION

Figure 1:
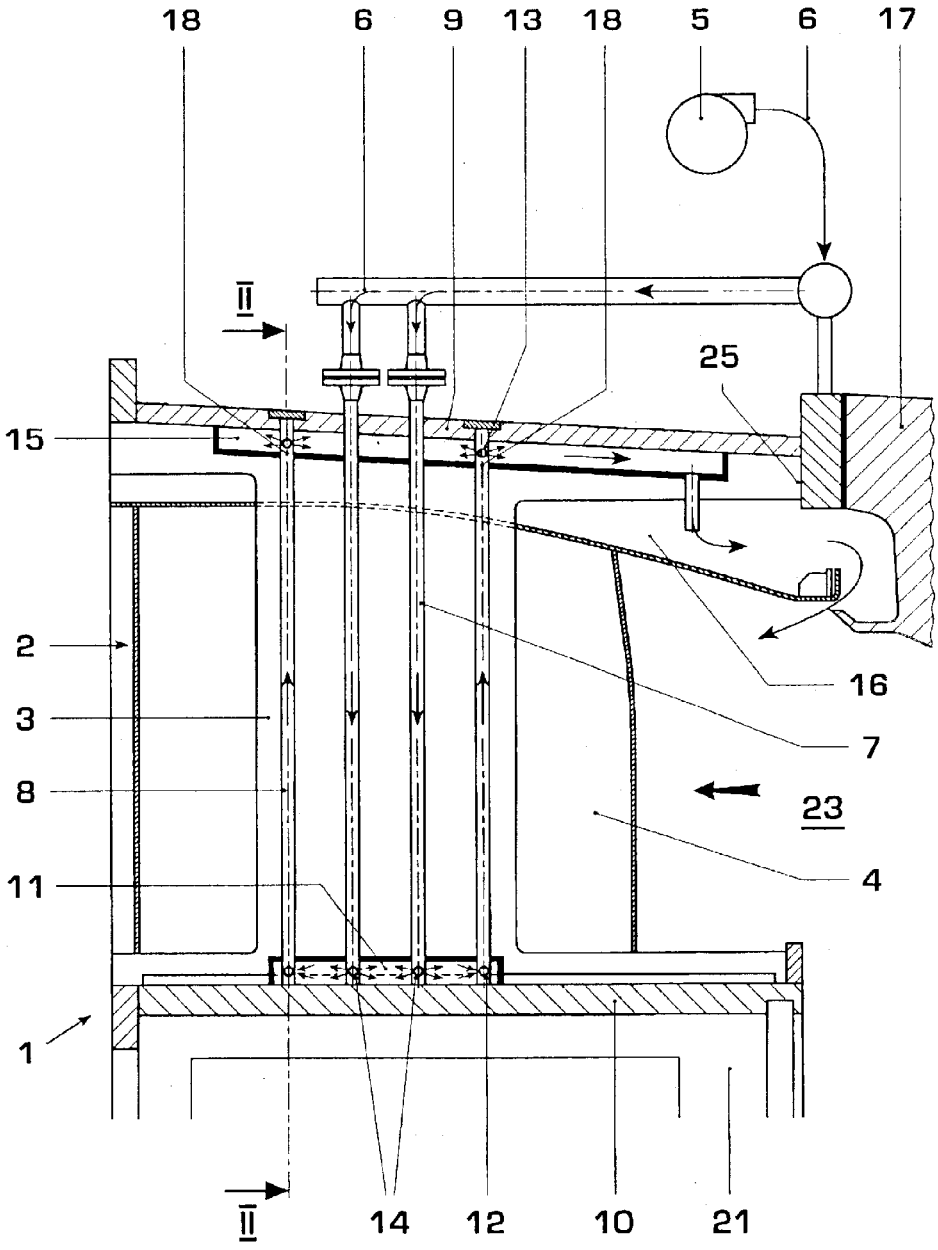
FIG. 1 shows a part longitudinal section of an exhaust gas housing of a thermal engine.

FIG. 1 shows the exhaust gas housing (1) of a thermal engine, here, for example, an axial-throughflow gas turbine plant. The exhaust gas housing (1) is in this case arranged downstream of the gas turbine, not illustrated, and is flanged to a housing (17) of the gas turbine by means of a flange (24). The exhaust gas housing (1) surrounds a bearing housing (21) for a rotor, not illustrated, of the gas turbine plant. The exhaust gas housing (1) comprises a radially outer exhaust gas housing casing (9) and a radially inner hub-side exhaust gas housing casing (10), which delimit an annular exhaust gas duct (23), carrying ribs (3) and a thermally insulating lining (4), these components forming an exhaust gas diffuser (2) for routing the exhaust gas flow. The carrying ribs (3) are in this arranged in a star-shaped manner in the exhaust gas diffuser (2) and transfer the bearing-body and the rotor weight of the gas turbine plant, said weight acting on the inner exhaust gas housing casing (10), to the outer exhaust gas housing casing (9) which, as a rule, rests on a carrying support, not shown. The carrying structure of the exhaust gas housing (1), then, is to be cooled in the event of high exhaust gas temperatures, so that the stability of the structure can be ensured. A further problem is presented by an uneven temperature distribution in the exhaust gas housing, since the housing is then distorted, and consequently mounting no longer takes place accurately, and the rotary is deflected out of center.

According to FIG. 1, cooling air is introduced via a tubular cooling medium supply (6) into passage ducts (7) of the carrying ribs (3) via a pressure source which, for example, may be an external fan (5) or the compressor of a gas turbine plant. Via outlet orifices (14) in the flow ducts (7), the cooling air enters a deflecting duct (11) which is arranged on or in the inner exhaust gas housing casing (10). From the deflecting duct (11), the cooling air again enters passage ducts (8) for the carrying ribs (3) via inlet orifices (12), in order to flow in countercurrent back to the outer housing casing (9) again. The cooling air then emerges, via at least partially throttlable outlet orifices (13), into a collecting duct (15), the collecting duct (15) either being placed onto the radially inner surface of the exhaust gas housing casing (9) or being integrated into the casing (9). The quantity of the cooling air which emerges via the outlet orifices (13) can be adjusted via externally manipulatable cooling air throttles (18) which change the opening cross section of the outlet orifices (13). The cooling air is discharged via the collecting duct (15), for example is introduced into the interspace (16) between the exhaust gas housing (1) and the lining (4), and enters the exhaust gas stream via a gap between the housing (17) of the gas turbine and the lining (4), in order to be intermixed with the exhaust gases.

In this case, the inner housing casing (10), too, is cooled by means of the deflecting duct (11), in the same way as the outer housing casing (9) also undergoes cooling by means of the collecting ducts (15).

Figure 2:
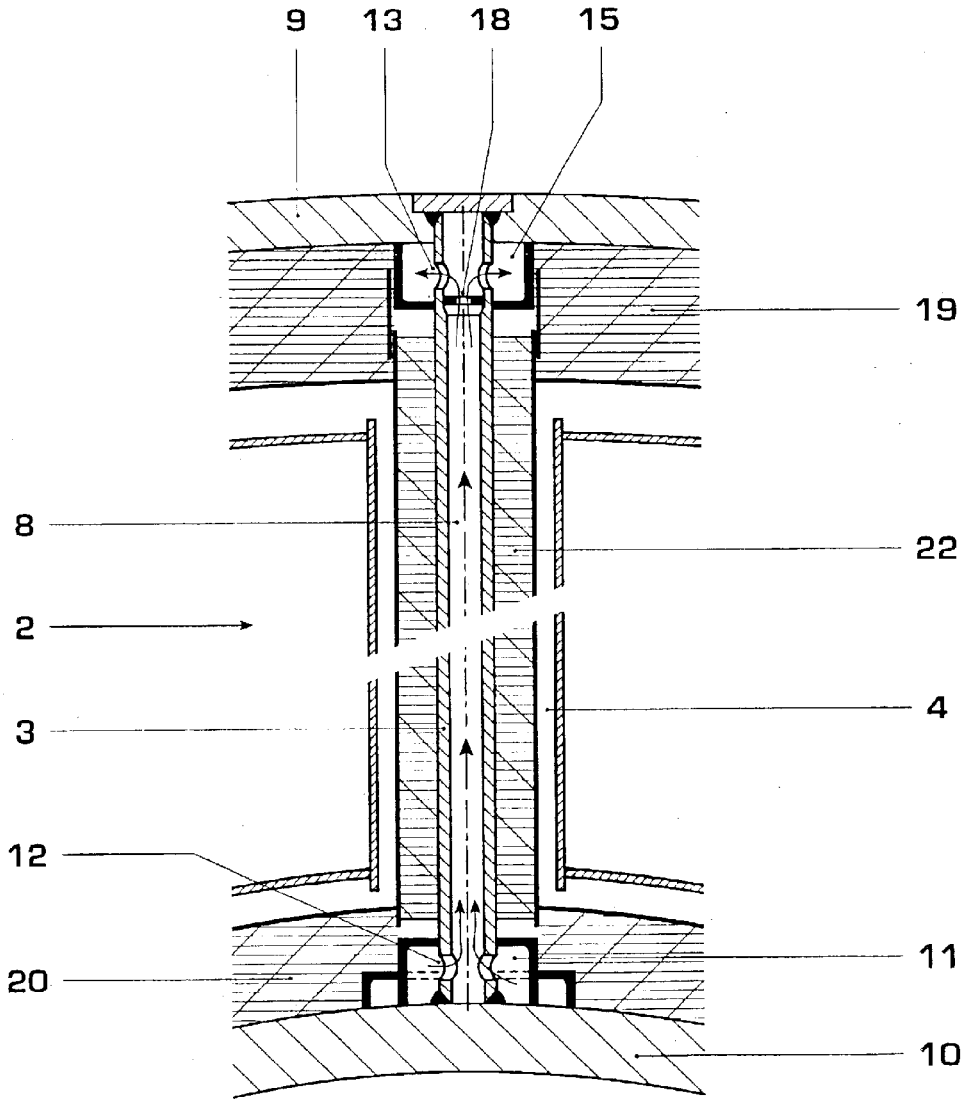
FIG. 2 shows a part cross section through a carrying rib of the exhaust gas housing along the line II—II in FIG. 1.

For thermal insulation, the carrying ribs (3) are sheathed, according to FIG. 2, with insulating cartridges (22) and with a lining (4). The outer housing casing (9) and the inner housing casing (10) are also thermally insulated by means of cartridges (19; 20) and shielded by means of a lining (4).

In the event of a failure of the external fan (5) and consequently of the cooling of the carrying ribs (3), there are nonetheless only slight restrictions in the availability of the thermal engine, since the illustrated measures for the thermal insulation of the carrying ribs (3) and of the exhaust gas housing casings (9) and (10) attenuate pronounced temperature fluctuations.

Figure 3:
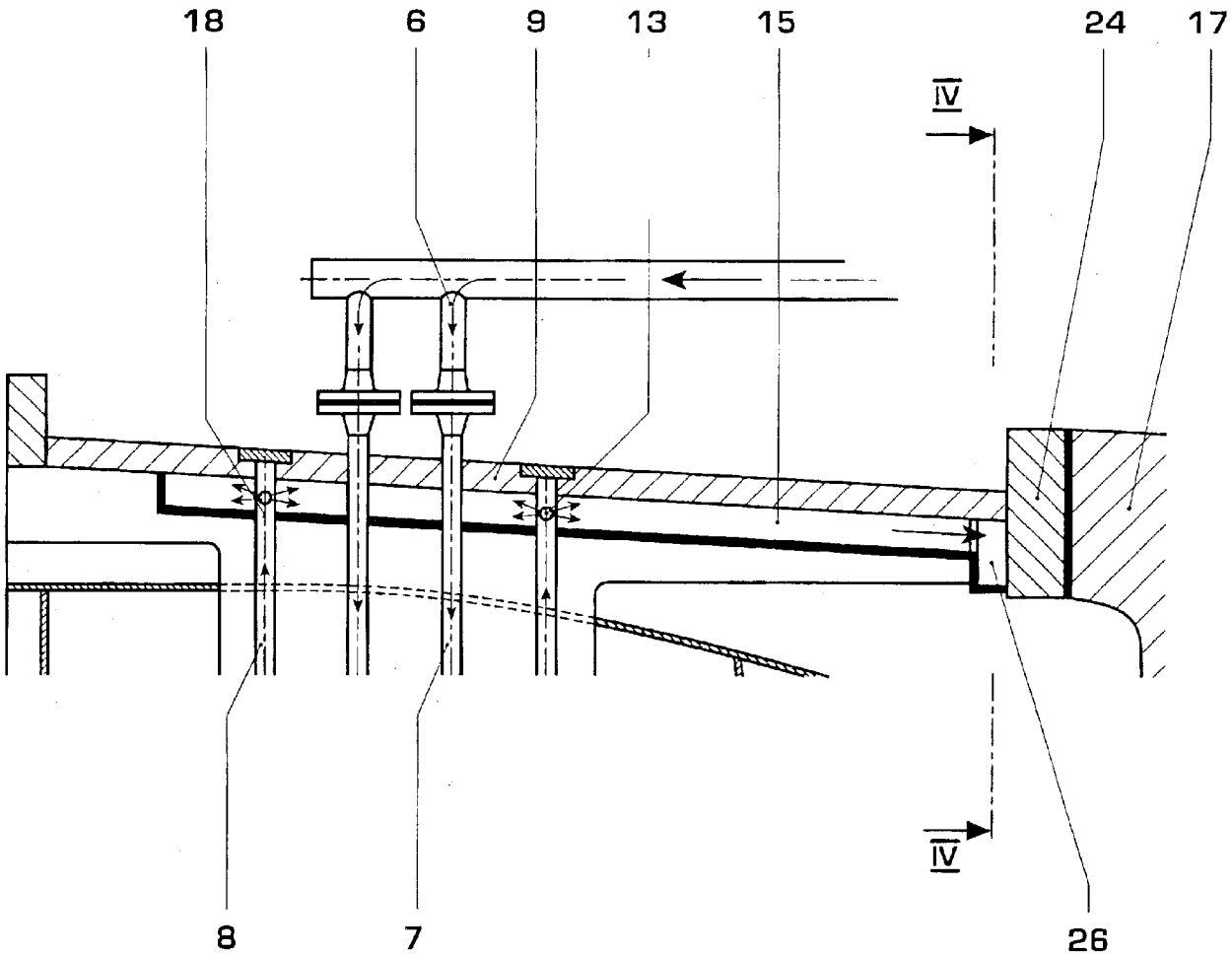
FIG. 3 shows a detail of an alternative embodiment.

FIG. 3 reproduces an embodiment which couples the cooling of the carrying ribs (3) with a cooling of the thermally highly loaded exhaust gas housing flange (24). For this purpose, the collecting duct (15) extends along the housing casing (9) as far as the housing flange (24). The flange (24), in turn, is equipped with an annular duct (26) on its surface (25) facing the exhaust gas duct (23), which annular duct (26) at least partially shields the surface (25). The collecting duct (15) issues, gastight, into the annular duct (26).

Figure 4:
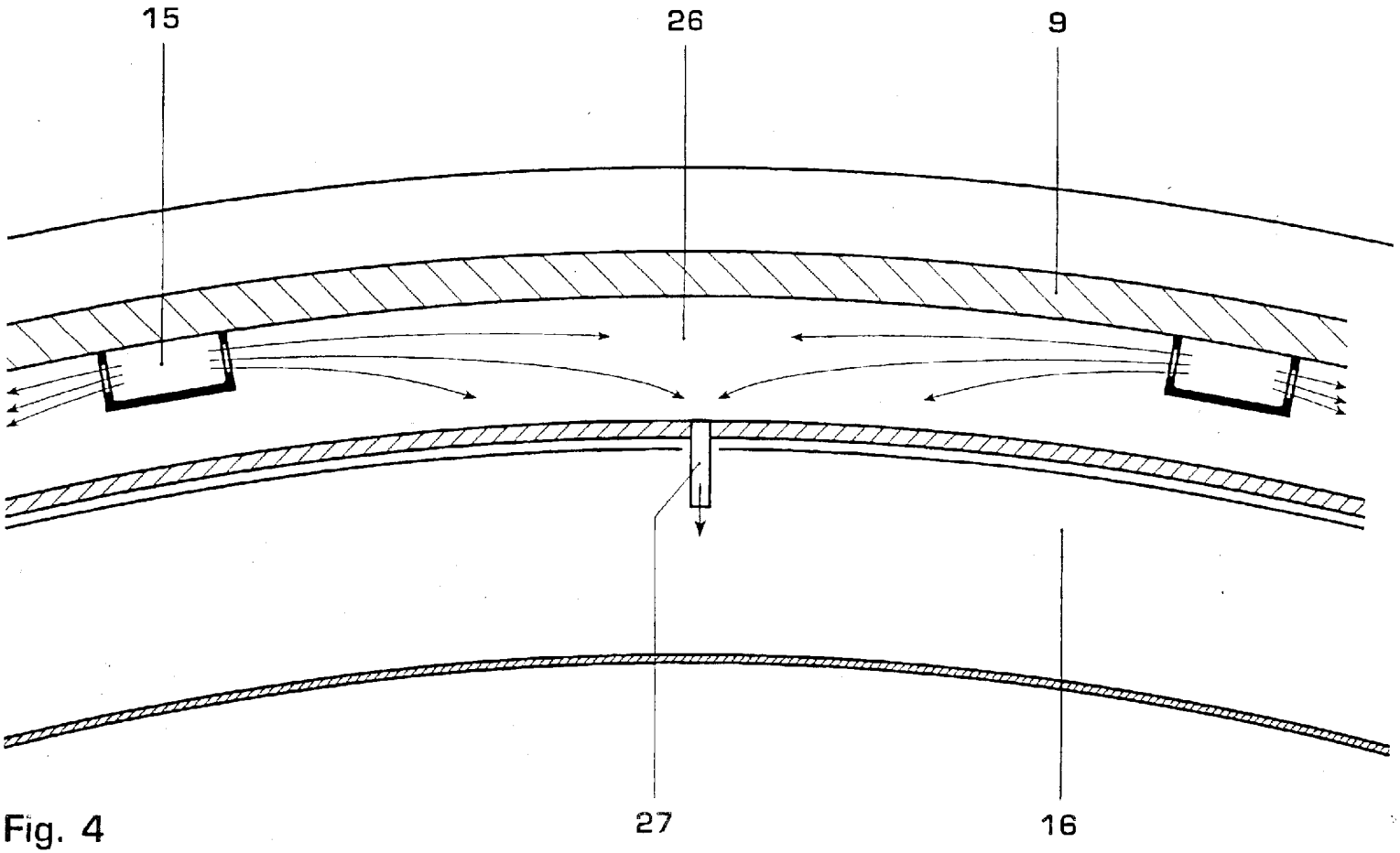
FIG. 4 shows a side view of an alternative embodiment.

As may be seen from FIG. 4, the cooling air flows out of the collecting duct (15), with a reversal of direction, into the annular duct (26), in order to flow there along the flange surface (25) in the direction of a pressure sink. Finally, the spent cooling air is discharged out of the annular duct (26) outward either through the housing (9) or the flange (24) or is released via outlet bores or small outlet tubes (27) in the annular duct wall into the interspace (16) and consequently admixed with the hot exhaust gases.

This embodiment assists the cooling of the exhaust gas housing flange (24) which, during operation, is exposed to a higher thermal stress than the adjacent turbine housing (17). In this way, a high temperature gradient between the housing parts (24) and (17) adjacent to one another is effectively prevented. Thermally induced stresses between the flange (24) and the turbine housing (17) are thus reduced and the risk of accompanying deformations is prevented.

The embodiments explained above are not, of course, to be understood in a restrictive sense. On the contrary, they are to be understood instructively and as an outline of the diversity of possible embodiments of the invention characterized in the claims.

List of Designations

1 Exhaust gas housing
2 Exhaust gas diffuser
3 Carrying rib
4 Lining
5 External fan
6 Cooling medium supply
7 Supply bore
8 Discharge bore
9 Outer exhaust gas housing casing
10 Inner exhaust gas housing casing
11 Deflecting duct
12 Inlet orifice
13 Outlet orifice
14 Outlet orifice
15 Collecting duct
16 Interspace
17 Housing of the thermal engine, for example gas turbine
18 Cooling air throttle
19 Insulating cartridge for (9)
20 Insulating cartridge for (10)
21 Bearing housing
22 Insulating cartridge for (3)
23 Exhaust gas duct
24 Exhaust gas housing flange
25 Thermally stressed surface of (24)
26 Annular duct
27 Outlet bore or small outlet tubes

What is claimed is:

1. An exhaust gas housing of a thermal engine, comprising a radially outer exhaust gas housing casing and, at a distance from this casing, a radially inner exhaust gas housing casing arranged on the hub side, said casings delimiting an annular exhaust gas duct, and a plurality of carrying ribs bridging the exhaust duct and cooled by means of a fluid cooling medium, wherein the carrying ribs have four passage ducts, in the region of the outer housing casing two ducts are equipped with means for a cooling medium supply and two ducts end in a collecting duct, and the four passage ducts are in communicating connection in the region of the inner housing casing via the deflecting duct.

2. The exhaust gas housing as claimed in claim 1, wherein the deflecting duet is arranged in the radially inner hub-side end region of the passage ducts.

3. The exhaust gas housing as claimed in claim 1, wherein the cooling medium supply comprises an external fan for acting upon the carrying ribs.

4. An exhaust gas housing of a thermal engine, comprising a radially outer exhaust gas housing casing and, at a distance from this casing, a radially inner exhaust gas housing casing arranged on the hub side, said casings delimiting an annular exhaust gas duct, and a plurality of carrying ribs bridging the exhaust duct and cooled by means of a fluid cooling medium, the carrying ribs have at least two passage ducts for the cooling medium, at least one passage duct possessing a cooling medium supply and at least one passage duct possessing a cooling medium outlet, and these passage ducts being in communicating connection in one end region via a deflecting duct, at least one of the ducts is equipped with throttles for adjusting the cooling medium throughput.

5. An exhaust gas housing of a thermal engine, comprising a radially outer exhaust gas housing casing and, at a distance from this casing, a radially inner exhaust gas housing casing arranged on the hub side, said casings delimiting an annular exhaust gas duct, and a plurality of carrying ribs bridging the exhaust duct and cooled by means of a fluid cooling medium, the carrying ribs have at least two passage ducts for the cooling medium, at least one passage duct possessing a cooling medium supply and at least one passage duct possessing a cooling medium outlet, and these passage ducts being in communicating connection in one end region via a deflecting duct, the passage ducts issue into a collecting duct which communicates with the exhaust gas duct of the thermal engine.

6. The exhaust gas housing as claimed in claim 5, wherein the collecting duct issues into an annular duct, which annular duct at least partially shields a thermally stressed surface of an exhaust gas housing flange.

7. An exhaust gas housing of a thermal engine, comprising a radially outer exhaust gas housing casing and, at a distance from this casing, a radially inner exhaust gas housing casing arranged on the hub side, said casings delimiting an annular exhaust gas duct, and a plurality of carrying ribs sheathed with a heat insulating material and bridging the exhaust duct and cooled by means of a fluid cooling medium, the carrying ribs have at least two passage ducts for the cooling medium, at least one passage duct possessing a cooling medium supply and at least one passage duct possessing a cooling medium outlet, and these passage ducts being in communicating connection in one end region via a deflecting duct.

8. The exhaust gas housing as claimed in claim 1, wherein the thermal engine is a gas turbine plant.

9. A method for cooling the carrying ribs of an exhaust gas housing of a thermal engine by means of a fluid cooling medium, said exhaust gas housing consisting of an outer casing and of an inner casing, wherein the cooling medium enters at least one passage duct of the carrying rib in the region of the outer housing casing, flows through this passage duct as far as the region of the inner housing casing, is deflected there and flows in countercurrent, in at least one passage duct, through the carrying rib as far as the region of the outer housing casing, and spent cooling medium is admixed with the exhaust gases of the thermal engine.

10. The method as claimed in claim 9, wherein the cooling medium is ambient air.

11. The exhaust gas housing as claimed in claim 4, wherein the thermal engine is a gas turbine plant.

12. The exhaust gas housing as claimed in claim 5, wherein the thermal engine is a gas turbine plant.

13. The exhaust gas housing as claimed in claim 7, wherein the thermal engine is a gas turbine plant.

14. The method as claimed in claim 9, wherein the thermal engine is a gas turbine plant.

* * * * *